United States Patent [19]

Boone

[11] Patent Number: 4,632,400

[45] Date of Patent: Dec. 30, 1986

[54] GOLF CLUB HEAD

[76] Inventor: David D. Boone, 21501 Rushford, El Toro, Calif. 92630

[21] Appl. No.: 747,811

[22] Filed: Jun. 21, 1985

[51] Int. Cl.[4] ..... A63B 53/04

[52] U.S. Cl. ..... 273/164; 273/167 K; 273/169

[58] Field of Search ..... 273/80.2, 78, 163 R, 273/183 D, 167 J, 164, 167 R–167 K, 168, 169–175, 80.1–80.9, 79, 77 R, 77 A; D21/214, 215, 216, 217, 218, 219, 220

[56] References Cited

U.S. PATENT DOCUMENTS

| | | | |
|---|---|---|---|
| 1,927,083 | 9/1933 | Davis | 273/164 |
| 2,007,976 | 7/1935 | Kraeuter | 273/80.2 |
| 3,519,271 | 7/1970 | Smith | 273/167 K |
| 4,512,577 | 4/1985 | Solheim | 273/78 |

*Primary Examiner*—George J. Marlo
*Attorney, Agent, or Firm*—Leonard Tachner

[57] ABSTRACT

A head for a golf club, the head having unique weight distribution by means of a window cutout along the shaft portion of the head and, in effect, transferred to the ball hitting portion of the head. Furthermore, the hosel is integral to the ball hitting portion at the lower portion of the club heel spaced from the topline, thereby leaving the entire topline and a portion of the heel adjacent the topline unencumbered by the hosel. The result is a golf club head which is more readily aligned with the golf ball, which has lower radial torque, and which provides more consistent trajectory and distance for off-center impact with the ball.

1 Claim, 7 Drawing Figures

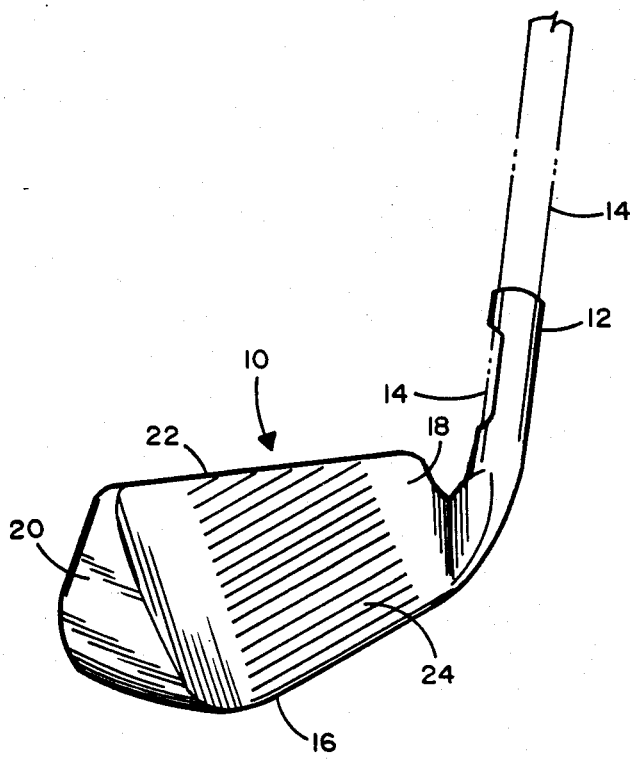
FIG. 1
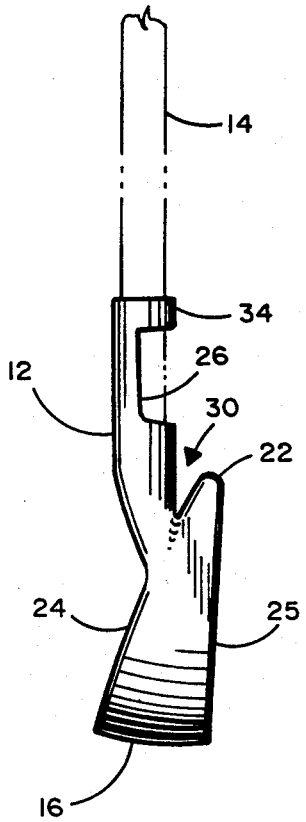
FIG. 2
FIG. 3
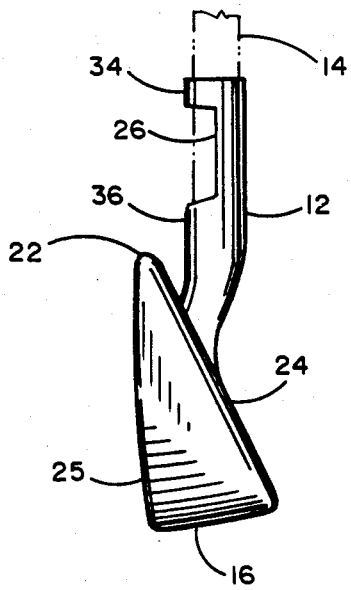
FIG. 4
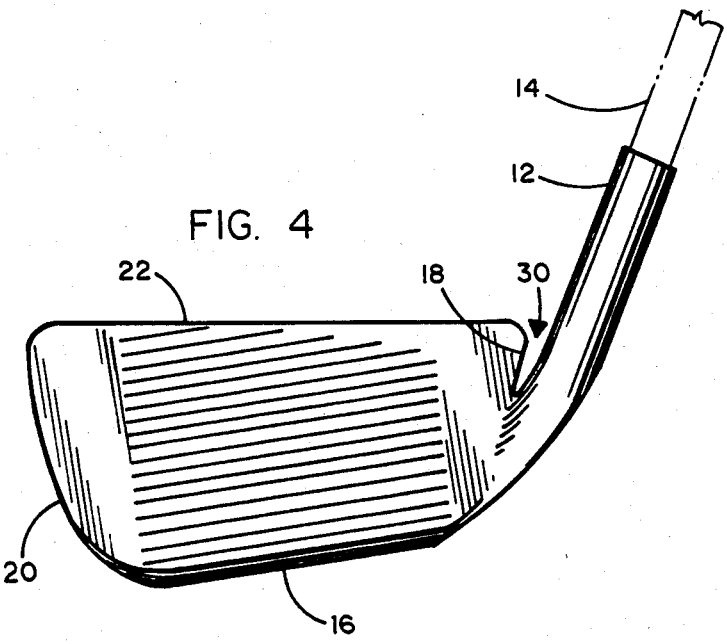

GOLF CLUB HEAD

BACKGROUND OF THE INVENTION

1. Field of the Invention

The present invention relates generally to the sport of golf and more particularly, to an improved golf club iron head design to permit the golfer to have more control in hitting the golf ball.

2. Prior Art

The game of golf is more than one hundred years old. In that time the configuration of golf clubs other than putters, has remained relatively constant in part due to the stringent rules established by the various golf associations including the United States Golf Association regarding golf clubs and in part due to the simplicity and apparent acceptance and satisfaction that conventional golf clubs generate in most golfers. However, golfers are generally always looking for different ways to improve their game by choosing golf clubs which are suitably shaped and of proper weight distribution to give them a greater sense of control of the ball within the rules specified by the various golf associations. Typical golf club irons utilize a metal head that is attached to the shaft by means of a neck or hosel. The various portions of the head are identified in relatively practical terms relating to the shape of the head. By way of example, the portion of the head that normally rests on the ground surface when the club is lowered to the ground is called the sole. The forward-most portion of the head is called the toe, the rear-most portion which is normally connected to the hosel or integral therewith, is called the heel and the upper-most surface of the head is called the topline.

The design of the club is dictated by specific club design regulations provided by way of example, by the United States Golf Association. For example, United States Golf Association rules specify that the club is composed of a shaft and a head with such parts being fixed so that the club is one unit. The club cannot be adjustable except for weight and must be similar to the traditional and customary form and make. The shaft must be straight with the same bending and twisting properties in any direction and attached to the club head at the heel either directly or through a single plane neck or socket. The club head must have a length from heel-to-toe that is greater than the breadth of the head from face-to-back and the club head must be generally planar in shape. Only one face can be designed for striking the ball, except for putters. The face of the club cannot have any degree of concavity and must be hard and rigid in relation to the ball. In the case of metal heads such as irons, no insert or attachment is permitted at the head or face of the club. The shaft must be straight from the top of the grip to a point not more than five inches above the sole measured along the shaft axis. The neck or hosel cannot be more than five inches in length measured from the top of the hosel or neck to the sole along the shaft axis. The shaft and the neck must remain in line with the heel or with the point to the right or left of the heel when the club is viewed in the address position and the distance between the axis of the shaft or the neck and socket of the back of the heel cannot exceed sixteen millimeters.

From all of these applicable rules regarding the club and the club head one can see that the freedom to vary the design of the club head in an effort to improve the control the golfer feels with respect to the ball when using the club, is severely constrained if that club is to be accepted by the applicable associations that regulate the game of golf such as the United States Golf Association. Despite these constraints however, the applicant herein has managed to design a novel golf head for irons which provides certain advantageous features that it is believed will improve the game of the golfer by increasing the degree of control the golfer exerts through the club to the ball.

SUMMARY OF THE INVENTION

The present invention relates to an improved golf club head having three principal features which patentably distinguish the present invention over the prior art and provide certain advantages which render the inventive golf club head of the present invention more attractive to golfers while abiding by the generally accepted rules of golf as previously described. More specifically, in the present invention the hose, neck or socket is designed to be lighter than conventional male or female hosels. This is achieved by eliminating a portion of the hosel between the top and bottom of the hosel, that is, between the end of the hosel connected to the shaft and the end of the hosel that is integral with the rest of the golf club head. This reduction in the weight of the hosel enables a transfer of the saved weight to the head which gives the golfer a better transfer of feel between the club, his hand and the ball while at the same time making the hosel less of an optical distraction from the rest of the golf club head. An additional feature of the present invention is the nature of the interconnection between the hosel and the rest of the golf club head. More specifically, in the present invention the hosel is integral with the sole end of the heel or at least the sole portion of the heel as opposed to the topline portion of the heel as is conventional in prior art clubs. As a result, the golf club head applies less torque on the shaft than would otherwise be applied and the shaft tip is closer to the sole thereby providing better utilization of the shaft. In addition, the cross section of the hosel remains more substantially continuous thereby further decreasing the weight of the hosel and allowing that weight to be redistributed to the head. Furthermore, the interconnection between the hosel and the club head improves the optical features of the head by limiting the opportunity for distraction and allowing the user to obtain an unencumbered view of the topline of the head. Furthermore, unlike conventional golf club heads, when the golfer addresses the ball by means of the present invention there is a readily apparent gap between the hosel and the topline.

As a result of the above-mentioned features of the present invention, more mass is transferred to the portion of the golf club head which impacts the golf ball and the golf club head design provides a center of gravity axis which is closer to being parallel with the sole line than can be found in a conventional club. This provides a consistency in trajectory and distance of the golf ball in the event of off-center impact between the head and the ball. Furthermore, the topline in relation to the gap between the head and the hosel provides certain optical advantages in alignment and illusion of the golf club head which improves the golfer's ability to control the club relative to the golf ball. Finally, the topline and sole line measured from the toe and heel are closer to being parallel to each other than one finds in a conventional golf club. This feature combined with the manner in which the hosel is attached to the sole portion of the head, reduces radial torque that is transmitted from the golf club head through the shaft to the hands when the shaft is flexing, loading or unloading or at impact with the golf ball during the golf swing.

OBJECTS OF THE INVENTION

It is therefore a principal object of the present invention to provide an improved head for golf club irons to provide a hosel or neck which is lighter than conventional hosels and therefore allows weight redistribution from the hosel to the ball contact portion of the golf club head.

It is an additional object of the present invention to provide an improved head for a golf club iron having a hosel designed to permit the lower tip of the golf shaft to be placed closer to the sole of the head.

It is still an additional object of the present invention to provide an improved head for a golf club iron in which the center of gravity axis as compared to the prior art is closer to being parallel with the sole line.

It is still an additional object of the present invention to provide an improved head for golf club irons in which there is a distinct gap between the hosel and the topline of the golf club head whereby to provide certain optical advantages in the alignment and the illusion of golf club head size for the golfer.

BRIEF DESCRIPTION OF THE DRAWINGS

The aforementioned objects and advantages of the present invention as well as additional objects and advantages thereof will be more fully understood hereinafter as a result of a detailed description of a preferred embodiment when taken in conjunction with the following drawings in which:

FIG. 1 is an isometric representation of the present invention;

FIG. 2 is an elevational view of the present invention taken from the heel side thereof;

FIG. 3 is an elevational view of the present invention taken from the toe side thereof;

FIG. 4 is an elevational view of the present invention taken from the face of the hitting surface thereof;

DETAILED DESCRIPTION OF A PREFERRED EMBODIMENT

Figure 5:
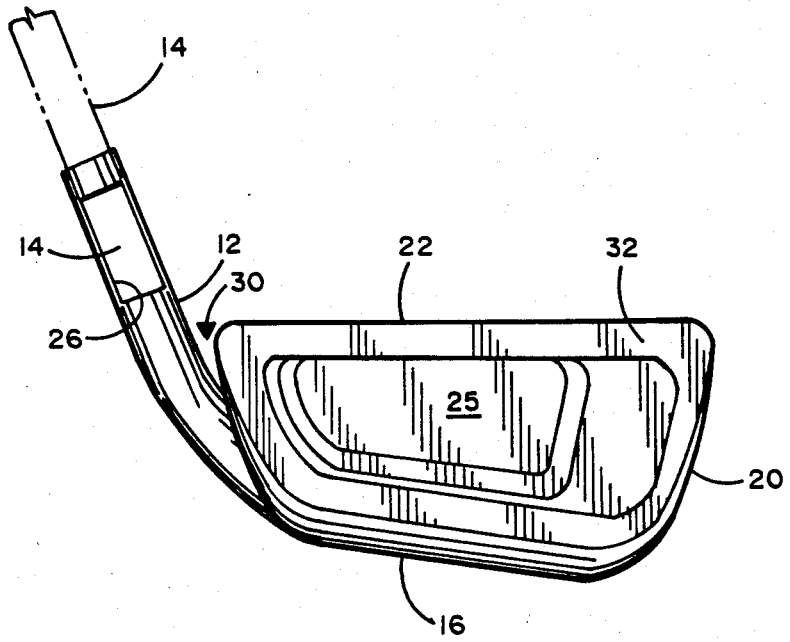
FIG. 5 is an elevational view of the present invention taken from the rear of the hitting surface thereof.
Figure 6:
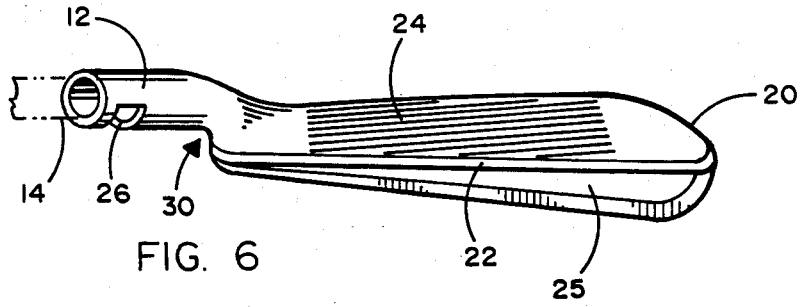
FIG. 6 is an elevational view of the present invention taken from the topline side thereof.
Figure 7:
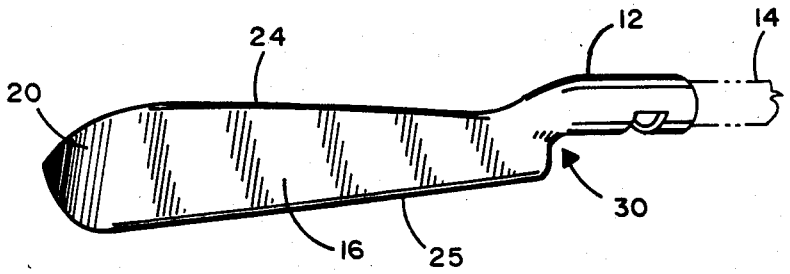
FIG. 7 is an elevational view of the present invention taken from the sole side thereof.

Referring to FIGS. 1–7 it will be seen that the novel golf club head 10 of the present invention comprises a hosel 12 of generally cylindrical shape adapted to receive a conventional golf club shaft 14 for securing the head thereto. The hosel is formed integrally with a ball hitting surface defined by a sole 16, a heel 18, a toe 20 and a topline 22. The sole, heel, toe and topline form the respective sides of a generally trapezoidal configured face 24, the planar view of which is shown best in FIGS. 2 and 3 and the elevational view of which is shown best in FIG. 4. Of course the sole, heel, toe and topline of the golf club head 10 also frame the rear face 25 of the golf club head as seen in FIG. 5. As shown in that figure the golf club head may be configured to have a recessed rear face 25 surrounded by a peripheral border 32 having increased mass relative to the center of the club. However, this feature of the illustrated embodiment is not deemed to be a novel feature of the invention nor is it deemed to be limiting in any respect as the invention will also yield highly advantageous results using a more conventional rear face surface shape.

Referring again to the figures it will be seen that the hosel 12 is provided with a window 26 which is defined by a non-circumferential portion of the hosel being cut-away leaving a fully circumferential portion 34 surrounding the shaft above the window 26 and a fully circumferential portion 36 also surrounding the shaft below the window 26. The principal purpose of this window 26 is to shift some of the weight in the hosel to the remainder of the club head to permit the unique club head configuration of the present invention without increasing the overall weight of the head. Furthermore, this shift in weight places more mass behind the ball hitting surface which it is believed will improve the golfer's performance with the club of the present invention.

Another highly advantageous and inventive feature of the present invention resides in the relationship between the hosel and the ball hitting surface of the club head. More specifically, as seen best in FIGS. 4 and 5, the hosel is connected or made integral to the heel of the ball hitting surface at a portion closest to the sole but spaced from the topline leaving a portion of the heel as a free surface unconnected to the hosel. Furthermore, this free surface of the heel closest to the topline and the exterior surface of the hosel adjacent the ball hitting surface, define a triangularly-shaped gap or space 30 between the hosel and the ball hitting surface. This gap or space 30 has the unique effect of allowing the golfer, when addressing the ball, to have a totally unobstructed view of the topline as well as of a portion of the heel of the club head as seen best in FIG. 6. This provides the golfer with optical advantages in aligning the club head relative to the golf ball and also gives the golfer the optical illusion of increased club head size. Furthermore, attaching the hosel to the lowest possible point at the heel of the club head, permits the head end of the golf shaft to be placed lower and closer to the sole of the head.

It has been found that redistributing the weight from the hosel to the ball hitting surface of the golf club head and connecting the hosel to the lowest possible point at the heel towards the sole of the club head, provides a center of gravity axis which is closer to being parallel with the sole line than is found in conventional prior art club heads. This produces the advantage of greater consistency in trajectory and distance of the golf ball in the event of off-center impact of the head with the ball. In addition, these features combine to reduce the radial torque that is transmitted from the club head through the shaft to the hands when the shaft is flexed or at impact with the golf ball and during other portions of the golf club swing.

It will now be understood that what has been disclosed herein comprises a unique unconventional design for a golf club head comprising a hosel having a window defined by a non-circumferential portion cut-away to reduce the weight of the hosel and transfer it to the ball hitting surface of the head. Furthermore, the hosel is integral with a portion of the heel that is spaced from the topline leaving an angular gap between the uppermost portion of the heel adjacent the topline and the hosel to permit the golfer to more readily align his club with the ball and afford greater control in hitting the ball.

Those having skill in the art to which the present invention pertains will, as a result of applicant's teaching herein, now perceive of various modifications and additions which may be made to the invention. By way of example, the general concept of lowering the weight of the hosel and shifting it to the club head may be achieved in other ways such as by using two different materials, one of lighter density for the hosel and one of greater density for the remaining portions of the club head. Furthermore, subtle changes in ball hitting surface geometry may still be made to the invention without deviating from the scope of the invention which is deemed to be limited only by the claims appended hereto.

I claim:

1. A head for a golf club iron comprising:

a hosel adapted for connection to a golf club shaft;

a ball hitting member of substantially trapezoidal configuration defined by a sole, a toe, generally vertical, straight heel line and a straight topline, said hosel being integral with said hitting member along said heel line, at least a portion of said heel line adjacent said topline being free of said hosel and defining one side of a gap between said hosel and said hitting member, and wherein extensions of said topline and said heel line intersect at an acute angle.

* * * * *